US007632620B2

(12) United States Patent
Giannetto et al.

(10) Patent No.: US 7,632,620 B2
(45) Date of Patent: Dec. 15, 2009

(54) COATED CARRIER

(75) Inventors: Brian S. Giannetto, Livonia, NY (US); Thomas J. Budny, Penfield, NY (US); Brian E. Moore, Ontario, NY (US); Zhaoyi M. Masucci, Penfield, NY (US); Samir Kumar, Pittsford, NY (US); Bernard A. Kelly, Ontario, NY (US); Lloyd D. Spencer, Wolcott, NY (US)

(73) Assignee: Xerox Corporation, Norwalk, CT (US)

( * ) Notice: Subject to any disclaimer, the term of this patent is extended or adjusted under 35 U.S.C. 154(b) by 310 days.

(21) Appl. No.: 11/045,883

(22) Filed: Jan. 28, 2005

(65) Prior Publication Data

US 2006/0172218 A1 Aug. 3, 2006

(51) Int. Cl.
*G03G 9/113* (2006.01)

(52) U.S. Cl. ..... 430/111.35; 430/111.1; 430/111.3

(58) Field of Classification Search ..... 430/111.1, 430/111.3; 399/159
See application file for complete search history.

(56) References Cited

U.S. PATENT DOCUMENTS

| | | | | |
|---|---|---|---|---|
| 3,590,000 | A | 6/1971 | Palermiti et al. | 252/62.1 |
| 4,233,387 | A | 11/1980 | Mammino et al. | 430/137 |
| 4,810,611 | A | 3/1989 | Ziolo et al. | 430/106.6 |
| 4,935,326 | A | 6/1990 | Creatura et al. | 430/108 |
| 4,937,166 | A | 6/1990 | Creatura et al. | 430/108 |
| 5,376,494 | A | 12/1994 | Mahabadi et al. | 430/137 |
| 5,656,408 | A | 8/1997 | Silence | 430/106.6 |
| 5,847,038 | A | 12/1998 | Silence et al. | 524/430 |
| 5,935,750 | A | 8/1999 | Barbetta et al. | 430/106.6 |
| 5,945,244 | A | 8/1999 | Barbetta et al. | 430/106.6 |
| 6,004,712 | A * | 12/1999 | Barbetta et al. | 430/111.35 |
| 6,010,812 | A | 1/2000 | Barbetta et al. | 430/106.6 |
| 6,042,981 | A * | 3/2000 | Barbetta et al. | 430/111.1 |
| 6,423,460 | B1 * | 7/2002 | Drappel et al. | 430/111.32 |
| 6,423,461 | B1 * | 7/2002 | Drappel et al. | 430/111.35 |
| 6,602,949 | B2 * | 8/2003 | Furukawa et al. | 524/806 |
| 2004/0036761 | A1 * | 2/2004 | Bannai | 347/243 |

FOREIGN PATENT DOCUMENTS

| | | |
|---|---|---|
| DE | 3926029 A1 | 2/1990 |
| EP | 0 080 018 A1 | 1/1983 |
| JP | 02046470 | 2/1990 |

* cited by examiner

*Primary Examiner*—Mark F Huff
*Assistant Examiner*—Peter L Vajda
(74) *Attorney, Agent, or Firm*—Fay Sharpe LLP

(57) ABSTRACT

A carrier comprised of a core, and thereover a polymer coating containing a first polymer and a silicone resin, and which resin possesses an average diameter of from about 300 to about 3,000 nanometers.

11 Claims, No Drawings

COATED CARRIER

RELATED PATENTS

Illustrated in U.S. Pat. Nos. 5,945,244; 6,042,981; 6,010,812 and 5,935,750, the disclosures of which are totally incorporated herein by reference, are carrier particles comprised, for example, of a core with coating thereover of polystyrene/olefin/dialkylaminoalkyl methacrylate, polystyrene/methacrylate/dialkyl aminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in U.S. Pat. No. 6,042,981 a carrier composition comprised of a core, and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in U.S. Pat. No. 6,010,812 a carrier comprised of a core, and a polymer coating of (1) styrene/monoalkylaminoalkyl methacrylate, or (2) styrene/dialkylaminoalkyl methacrylate; and in U.S. Pat. No. 5,935,750 a carrier comprised of a core and a polymer coating containing a quaternary ammonium salt functionality.

The appropriate components and processes of the above recited related patents may be selected for the present disclosure in embodiments thereof.

BACKGROUND

This invention is generally directed to developer compositions, and more specifically, the present disclosure relates to developer compositions with coated carrier components, or coated carrier particles that can be prepared by, for example, dry powder processes, and wherein the coating is a polymer, or mixtures thereof containing a silicone resin or resins, such as TOSPEARL XC99-A8808™, TOSPEARL 105™ or TOSPEARL 120™, a silicone polymer available from GE Silicones, and wherein the TOSPEARL™ has been characterized as monodispersed particles of an alkyltrialkoxysilane hydrolyzed and condensed into spherical resin particles. TOSPEARL™ is believed to possess a network structure with siloxane bonds extending three-dimensionally, and wherein the silicon atoms can be bonded with one methyl group, in a structure intermediate between inorganic and organic, for example, of the formula wherein R is methyl

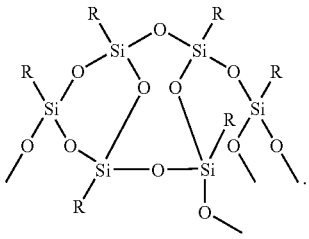

Alkyltrialkoxysilane can also be considered as a material wherein the alkyl prefix varies based on the number of carbon atoms in a continuous sequence bonded to the silicone atom, and also manufactured by Toshiba Silicone Company, a fine powder with a medium particle size diameter of from about 200 to about 3,000 nanometers, more specifically from about 300 to about 1,000 nanometers, and yet more specifically from about 400 to about 800 nanometers; and still more specifically about 500 nanometers, such as methylsilsesquioxane TOSPEARL XC99-A8808™. More specifically, the present disclosure relates to compositions, especially carrier compositions comprised of a core, and thereover at least one polymer, and dispersed therein and thereon a silicone polymer of a suitable average size as illustrated herein, such as from about 300 to about 2,000 nanometers, more specifically from about 400 to about 1,000 nanometers, and yet more specifically from about 500 to about 700 nanometers; carrier particles containing the silicone resins disclosed herein can impact triboelectric charge without affecting or minimizing carrier or developer conductivity, and wherein the nanometer size of the silicone polymer ensures that the silicone can be processed in a binder resin resulting in silicone beads becoming embedded in the fused polymer coating, such as polymethylmethacrylate (PMMA), firmly attaching the silicone particles to the carrier surface. Also, with the silicon resin or resins contained in the polymer coating there are enabled excellent developer triboelectric characteristics, and wherein in embodiments the carrier triboelectric charges can be adjusted to preselected values without adversely impacting other carrier properties, such as carrier conductivity, developer relative humidity sensitivity, and other functional properties.

In embodiments of the present disclosure, the carrier particles are comprised of a core with a coating thereover of a polymer, such as a polymethylmethacrylate (PMMA) and the like, including copolymers of methylmethacrylate and dimethylaminoethyl methacrylate, methylmethacrylate copolymers with substituted alkyl aminoethyl methacrylate, butylaminoethyl methacrylate, and the like, and which polymer coating contains a silicone polymer. The carrier may include the polymer coating thereover in admixture with other suitable polymers, and more specifically, with a second polymer, such as a fluoropolymer, polymethylmethacrylate, poly(urethane), especially a crosslinked polyurethane, such as a poly(urethane)polyester and the like, and moreover, the copolymer coating contains in place of a conductive component, such as carbon black, silicone polymer of nanometer size, and which silicone polymer component is dispersed in and on, or in the polymer coating. With the silicone polymer component, there can be enabled carriers with increased developer triboelectric response at relative humidities of from about 20 to about 90 percent, conductivity ranges that are unchanged in comparison to carriers without silicone particles in the carrier coating, and carrier conductivity ranges of from about $10^{-11}$ to about $10^{-6}$ (ohm-cm)$^{-1}$. An advantage associated with the carriers of the present disclosure with the polymer coatings thereover include a decreased triboelectrical charge, for example, a carrier tribo of from about a plus (positive charge) 47 to about 60, or to about 53 microcoulombs per gram, and wherein decreased refers, for example, to from about 15 to about 25 microcoulombs per gram from the initial charge. Thus, when the initial carrier charge is about 50, this charge can be reduced to about 30 subsequent to the addition of the silicone resin. Carrier coating containing the silicone resin in amounts of from about 0.06 to about 0.5 percent by weight based on the weight percent of the total of the core, polymer coating and the silicone resin, had a triboelectric range of about 23 to about 47 microcoulombs per gram as determined by the known Faraday Cage method.

The carrier particles of the present disclosure can be selected for a number of different imaging systems and devices, such as xerographic copiers and printers, inclusive of high speed color xerographic systems, printers, digital systems, a combination of xerographic and digital systems, and wherein colored images with excellent and substantially no background deposits are achievable. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected and then decreased, which charge is dependent, for example, on the polymer composition and dispersant component applied to the carrier core, and optionally the type and amount of the silicone resin selected.

REFERENCES

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of value with respect to the aforementioned developer compositions are the appropriate triboelectric charging values associated therewith, especially at a variety of relative humidities.

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some known carrier coatings resides in fluctuating triboelectric charging characteristics, particularly with changes in relative humidity, and relatively low triboelectrical values.

There is illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The appropriate components and processes of the '166 and '326 patents may be selected for the present disclosure in embodiments thereof. The present disclosure has the advantage over this prior art of achieving high positive triboelectric charge on the carrier particles, that is high, up to about 150 negative triboelectric charge, is imparted to the toner particles developed onto a photoreceptor in, for example, a xerographic development environment. Further, the full range of electrical properties of the carrier particles can be achieved at high triboelectric charging values, from carrier conductivities of $10^{-17}$ mho/cm to $10^{-6}$ mho/cm, that is, from the insulative to the conductive regime, and the carrier triboelectric charge and carrier conductivity can be varied and preselected.

Also of interest is U.S. Pat. No. 5,656,408, the disclosure of which is totally incorporated herein by reference, which discloses a carrier composition comprised of a core with a coating thereover comprised of a polyester, and which polyester comprises linear portions and crosslinked portions, and wherein said crosslinked portions are comprised of high density crosslinked microgel particles.

When resin coated carrier particles are prepared by powder coating process the majority of the coating materials are fused to the carrier surface thereby reducing the number of toner impaction sites on the carrier. Additionally, there can be achieved with the process of the present disclosure and the carriers thereof, independent of one another, desirable triboelectric charging characteristics and conductivity values; that is, for example, the triboelectric charging parameter is not necessarily dependent on the carrier coating weight as is believed to be the situation with the process of U.S. Pat. No. 4,233,387, the disclosure of which is totally incorporated herein by reference, wherein an increase in coating weight on the carrier particles may function to also permit an increase in the triboelectric charging characteristics. Specifically, therefore, with the carrier compositions and process of the present disclosure there can be formulated developers with selected triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{-1}$ to about $10^{-17}$ (ohm-cm)$^{-1}$, more specifically from about $10^{-10}$ (ohm-cm)$^{-1}$ to about $10^{-6}$ (ohm-cm)$^{-1}$, and yet more specifically from about $10^{-8}$ (ohm-cm)$^{-1}$ to about $10^{-6}$ (ohm-cm)$^{-1}$, and carrier triboelectric charging values as illustrated herein as determined by the known Faraday Cage technique. Thus, the developers of the present disclosure can be formulated with conductivity values in a certain range with different triboelectric charging characteristics by, for example, maintaining the same total coating weight on the carrier particles.

Disclosed in U.S. Pat. No. 5,847,038, the disclosure of which is totally incorporated herein by reference, is a process which comprises subjecting a mixture of a polymer, a conductive component and an additive to mechanical energy of from about 1 to about 20 kilowatt hours per kilogram and an intensity of from about 20 to about 90 kilowatts per kilogram, and wherein said subjecting is accomplished until said additive is substantially permanently embedded in said polymer.

SUMMARY

It is a feature of the present disclosure to provide toner and developer compositions with carrier particles containing polymer coatings or a polymer coating, and wherein at least one coating contains a silicone resin.

In another feature of the present disclosure there are provided dry coating processes for generating carrier particles of substantially constant conductivity parameters.

In yet another feature of the present disclosure there are provided dry coating processes for generating carrier particles of substantially constant conductivity parameters, and high triboelectric charging values.

In yet a further feature of the present disclosure there are provided carrier particles wherein the tribo values thereof can be decreased from about 15 to about 25 to arrive at a triboelectric charge of at least about 22 to about 38 microcoulombs per gram, and wherein the carrier includes thereover a polymer, or a coating of two polymers, and wherein the second polymer is a copolymer of polymethylmethacrylate and poly(urethane), and wherein the coating contains therein a silicone resin component of an average diameter of about 300 to about 800 nanometers.

Moreover, another feature of the present disclosure is to provide carriers containing a silicone coating wherein the coating reduces/minimizes the amount of toner additives embedded in the carrier polymer coating, such as a polymethylmethacrylate, wherein the size diameter of the silicone resin can be, for example, about ten times that of the toner additives, such as silica, and/or wherein the toner resin is about ten times the diameter of the silicone resin, or other suitable sizes for the silicone resin that permit spacing between the carrier and the toner, and also in embodiments wherein there results an irregular or bumpy carrier surface.

Aspects of the present disclosure relate to a carrier comprised of a core and thereover a polymer containing a nanometer size silicone resin; a carrier comprised of a core, and thereover at least one polymer coating containing a silicone resin, and which resin possesses an average diameter of from about 300 to about 3,000 nanometers; a developer comprised of (1) a carrier core and polymer coating layer thereover, and wherein the polymer contains dispersed therein and/or thereon a silicone resin; and (2) a toner; a process for reducing the triboelectric charge of a carrier and which process comprises adding a silicone resin to a carrier comprised of a core and at least one polymer thereover; a carrier wherein the diameter is from about 300 to about 1,000 nanometers, and wherein the silicone resin is in a powder form; a carrier wherein the diameter is from 400 to about 800 nanometers; a carrier wherein the polymer is a polyalkylmethacrylate; a carrier wherein the polymer is poly(methylmethacrylate); a carrier wherein the polymer is comprised of a mixture of polymers; a carrier wherein the mixture contains from about 2 to about 5 polymers; a carrier wherein the polymer coating weight is from about 0.1 to about 20 weight percent; a carrier wherein the polymer coating weight is from about 1 to about 3 weight percent; a carrier wherein the polymer coating contains dispersed therein the silicone resin; a carrier wherein the core is a metal, a metal oxide, or a ferrite; a carrier with a triboelectric charge of from about 20 to about 50 microcoulombs per gram; a carrier with a triboelectric charge of from about a positive 25 to about a positive 35 microcoulombs per gram; a developer comprised of the carrier previously presented and toner; a developer wherein the toner is comprised of thermoplastic resin and colorant; a developer wherein the colorant is a pigment and the resin is a styrene copolymer, or a polyester; a developer wherein the carrier core is selected from the group consisting of iron, ferrites, steel and nickel; a developer with a carrier triboelectric charge of from about a positive 20 to about a positive 35 microcoulombs per gram, and a toner triboelectric charge of from about a negative 20 to about a negative 35 microcoulombs per gram; carrier wherein the second polymer is comprised of a styrene acrylate, a styrene methacrylate, or a fluoropolymer; a carrier wherein the second polymer is comprised of a polyurethane, and which polyurethane optionally contains dispersed therein conductive components; a carrier wherein the second coating is comprised of a polyurethane/polyester; an imaging process which comprises developing an image with the developer previously presented; a process for the preparation of the carrier previously presented by the dry mixing and heating of said core and said coating containing said silicone resin; a carrier wherein the silicone resin is an alkylsilsesquioxane; a carrier wherein the resin is present in an amount of from about 0.05 to about 0.50 weight percent, and wherein the alkyl contains from 1 to about 12 carbon atoms; a carrier wherein the resin is present in an amount of from about 0.15 to about 0.35 weight percent; a carrier wherein the resin is present in an amount of from about 0.20 to about 0.30 weight percent; a carrier wherein the silicone resin is an alkyltrialkoxysilane; a carrier wherein the alkyl and the alkoxy possess from about 1 to about 12 carbon atoms; a carrier wherein the resin is present in an amount of from about 10 to about 30 weight percent of the polymer coating, and the polymer coating is a polymethylmethacrylate (PMMA); a carrier which possesses a triboelectric charge of from about 22 to about 38, and wherein the charge is reduced from about 47 to about 60 microcoulombs per gram, and which carrier possesses a conductivity of from about $10^{-8}$ to about $10^{-9}$ $(\text{ohm-cm})^{-1}$, or from about $10^{-6}$ to about $10^{-11}$ $(\text{ohm-cm})^{-1}$; a process wherein the reduction is from about 15 to about 25 microcoulombs per gram; a carrier wherein the silicone resin is a methylsilsesquioxane; a carrier wherein the silicone resin is a methylsilsesquioxane of the formula

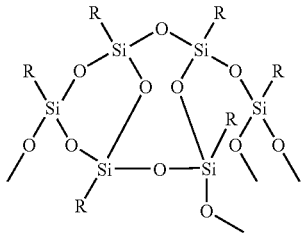

wherein R is methyl; a xerographic apparatus comprised of a charging component, a photoconductive component, an imaging component, a development component, and a transfer component and wherein the development component contains the developer previously presented; a carrier comprised of a core and thereover a polymer coating containing a silicone, polymer, and a second polymer; and optionally wherein the silicone possesses an average diameter of from about 300 to about 3,000 nanometers; a carrier wherein the polymer coating weight thereof is from about 0.1 to about 20 weight percent; a carrier wherein the polymer coating weight is from about 1 to about 3 weight percent; a carrier wherein the polymer coating is comprised of a first polymer like PMMA, and dispersed therein a silicone resin, and which resin is selected, for example, in an amount of from about 10 to about 60, and more specifically from about 10 to about 30 weight percent; a carrier wherein the core is a metal, a metal oxide, or a ferrite; a carrier with a triboelectric charge of from about a positive 20 to about a positive 55 microcoulombs per gram; a carrier with a triboelectric charge of from about 20 to about 30 microcoulombs per gram; a developer comprised of a coated carrier and toner; a developer wherein the toner is comprised of thermoplastic resin and colorant; a developer wherein the colorant is a pigment and the toner resin is a styrene copolymer, or a polyester; a developer comprised of (1) a carrier core and coating layer of a polymer or polymers, and a silicone polymer which polymer can function as a conductive component, and also functions to reduce the carrier triboelectric charge; and (2) a toner; a developer wherein the carrier core is selected from the group consisting of iron, ferrites, steel and nickel; a carrier wherein the nonsilicone resin polymer coating is PMMA, sodium lauryl sulfate PMMA (SLS PMMA); a copolymer of methylmethacrylate/dimethyl aminoethyl methacrylate; a copolymer of methylmethacrylate and tertiary-butylaminoethyl methacrylate; a copolymer of methylmethacrylate and diethylaminoethyl methacrylate; a copolymer of methylmethacrylate and diisopropylaminoethyl methacrylate; or a copolymer of methylmethacrylate and an alkylaminoethyl methacrylate; a carrier wherein the carrier contains a second polymer coating; a carrier wherein the second coating is comprised of a styrene acrylate, a styrene methacrylate, or a fluoropolymer; a carrier wherein said second coating is comprised of a polyurethane and which polyurethane contains dispersed therein a silicone resin; a carrier wherein the substituted alkyl aminoethyl methacrylate is a tertiarybutylaminoethyl methacrylate; a carrier comprised of a core, and a coating of polymers of alkylmethacrylate and an alkylaminoalkyl methacrylate, and a silicone resin; and a carrier comprised of a silicone resin of the formula

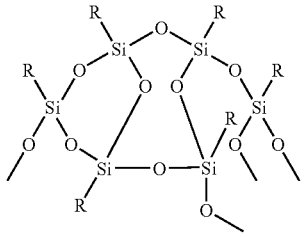

wherein R is, for example, alkyl of from 1 to about 18 carbon atoms, and which resin contains at least one polymer.

The present disclosure is directed to, for example, developer compositions comprised of toner particles, and carrier particles prepared, for example, by a powder coating process, and wherein the carrier particles are comprised of a core with certain coatings thereover; carrier particles prepared by mixing low density porous magnetic, or magnetically attractable metal core carrier particles with from, for example, between about 0.05 percent and about 3 percent by weight, based on the weight of the coated carrier particles of certain polymers, and wherein at least one polymer contains a silicone resin until adherence thereof to the carrier core by mechanical impaction or electrostatic attraction; heating the resulting mixture of carrier core particles and polymer to a temperature, for example, of from about 200° F. to about 625° F., preferably about 400° F., for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Various suitable solid core carrier materials can be selected for the carriers and developers of the present disclosure. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such iron or steel powders available from Hoeganaes Corporation; ferrites such as Cu/Zn-ferrite containing, for example, about 11 percent copper oxide, 19 percent zinc oxide, and 70 percent iron oxide and available from D. M. Steward Corporation or Powdertech Corporation, Ni/Zn-ferrite available from Powdertech Corporation, Sr (strontium)-ferrite containing, for example, about 14 percent strontium oxide and 86 percent iron oxide and available from Powdertech Corporation, Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of, for example, from between about 30 microns to about 400 microns, and more specifically from about 60 to about 100 microns.

The process for incorporating polymer or mixtures thereof onto a carrier core can be sequential, a process in which one of the two polymers, when two polymers are selected, is fused to the surface in a first step, and the second polymer is fused to the surface in a subsequent fusing operation. Alternatively, the process for incorporation can comprise a single fusing.

Examples of silicone resins or polymers, usually present in an amount of from about 0.06 to about 0.5 percent, and more specifically from about 0.2 to about 0.3 by weight based on the weight percent of the total of the core, polymer coating and the silicone resin include an alkyltrialkoxysilane with, for example, from about 1 to about 18, or from about 1 to about 10 carbon atoms for alkyl and alkoxy, more specifically a methylsilsesquioxane, such as TOSPEARL XC99-A8808™, TOSPEARL 105™ and TOSPEARL 120™, with a medium particle size diameter of from about 300 to about 3,000 nanometers, more specifically from about 300 to about 1,000 nanometers, and yet more specifically from about 400 nanometers to about 800 nanometers, and yet more specifically about 500 nanometers, and which resulting carriers possess a reduced triboelectric charge, for example a reduction of about 15 to about 25 microcoulombs without changing conductivity.

Also, the carrier coating may in embodiments have incorporated therein various known charge enhancing additives, such as quaternary ammonium salts, and more specifically, distearyl dimethyl ammonium methyl sulfate (DDAMS), bis [1-[(3,5-disubstituted-2-hydroxyphenyl)azo]-3-(mono-substituted)-2-naphthalenol silicone polymer (2-)]chromate(1-), ammonium sodium and hydrogen (TRH), cetyl pyridinium chloride (CPC), FANAL PINK® D4830, and the like, including those as illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

Examples of second polymers selected can include polymonoalkyl or dialkyl methacrylates or acrylates, polyurethanes, fluorocarbon polymers such as polyvinylidenefluoride, polyvinylfluoride, polypentafluorostyrene, polyethylene, polyethylene-co-vinylacetate, polyvinylidenefluoride-co-tetrafluoroethylene, and the like, inclusive of other known suitable polymers. Other known related polymers not specifically mentioned herein may also be selected, such as those illustrated in the U.S. Pat. Nos. 4,937,166 and 4,935,326 mentioned herein, the disclosures of which are totally incorporated herein by reference.

A specific second polymer is comprised of a thermosetting polymer and yet, more specifically, a poly(urethane) thermosetting resin, which contains, for example, from about 75 to about 95, and preferably about 80 percent by weight of a polyester polymer, which when combined with an appropriate crosslinking agent, such as isopherone diisocyanate and dibutyl tin dilaurate, forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the conductive component in the first polymer.

Various effective suitable processes can be selected to apply the polymer, or mixture thereof, for example from 2 to about 5 and preferably 2, of polymer coatings to the surface of the carrier particles. Examples of typical processes for this purpose include combining the carrier core material, and the polymers and silicone resin component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-6}$ to about $10^{-11}$ mho-cm$^{-1}$ as measured, for example, across a 0.1 inch magnetic brush at an applied potential of 30 volts; and wherein the coating coverage encompasses from about 10 percent to about 100 percent of the carrier core. Moreover, known solution processes may be selected for the preparation of the coated carriers.

Illustrative examples of toner binders include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins, such as ethylene, propylene, butylene and isobutylene; vinyl halides, such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments, dyes, or mixtures thereof, and preferably pigments can be selected as the colorant for the toner particles including, for example, carbon black, nigrosine dye, lamp black, iron oxides, magnetites, and mixtures thereof, known cyan, magenta, yellow pigments, and dyes. The colorant, which is preferably carbon black, should be present in a sufficient amount to render the toner composition highly colored. Thus, the colorant can be present in amounts of, for example, from about 1 percent by weight to about 20 percent by weight, and more specifically from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, inclusive of dyes thereof can be selected. These colorants are generally present in the toner composition in an amount of from about 1 weight percent to about 15 weight percent, and for example, from about 2 to about 12 weight percent based on the weight of the toner components of binder and colorant.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present disclosure can be prepared by a number of known methods including melt blending the toner resin particles, and colorants of the present disclosure followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particle sizes and shapes are known and include, for example, a toner size of from about 2 to about 25, and more specifically from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules, there can be selected the aryl diamines disclosed in the aforementioned patents, such as the '990 patent. These layered members are conventionally charged negatively thus requiring a positively charged toner.

Images, especially colored images, obtained with the developer compositions of the present disclosure in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

At least one polymer refers, for example, to one to two to ten, to two to seven; to two; and the like.

The following Examples are provided.

CARRIER EXAMPLE I

Preparation of 0.06 Percent by Weight of the Silicone Resin TOSPEARL 105™ and 0.54 Percent by Weight of Polymethylmethacrylate Coated Carrier There was prepared by mixing in a 5 liter M5R blender (available from Littleford Day Inc., Florence, Ky.) a polymer premix of 10 percent by weight of a silicone resin, and more specifically, a methylsilsesquioxane (TOSPEARL 105™) with a medium particle size diameter of from about 400 to about 800 nanometers, (available commercially from GE Silicones Inc., Waterford, N.Y.), and 90 percent by weight of polymethylmethacrylate (MP-116 available commercially from Soken Chemical and Engineering Company, Ltd., Tokyo, Japan). The polymer premix product was blended for 4 minutes at 400 rpm.

Subsequently, a core/polymer premix was produced by combining 326.6 grams of the above generated resulting silicone polymer premix with 120 pounds of 82 micron volume median diameter irregular steel core (obtained from Hoeganaes—core size determined in this and all following carrier Examples by a standard laser diffraction technique) were mixed in a Munson style blender (Model #MX-1, obtained from Munson Machinery Company Inc., Utica, N.Y.). The mixing was accomplished at 27.5 rpm for a period of 30 minutes. There resulted uniformly distributed and electrostatically attached polymer premix on the steel core as determined by visual observation.

The resulting mixture was then processed in a seven inch i.d. rotary furnace (obtained from Harper International Inc., Lancaster N.Y.) under the conditions of 6 rpm, feedrate of 650 grams/minute and furnace angle of 0.6 degree. The conditions presented (rpm, feedrate and angle) are some of the primary factors that drive the residence time and volume loading which are the desired parameters for fusing the coating to the carrier core. Residence time is calculated as the quotient of the weight of the core/polymer mixture in the muffle section (heated section) of the kiln and the feedrate of the materials. The resulting residence time of the above carrier at the above setpoints was 27.5 minutes. The volume loading of the kiln at the above setpoints was 9.14 percent of the total volume of the kiln. The peak bed temperature of the core/polymer mix as it traveled through the furnace under these conditions was 452° F., thereby causing the polymer to melt and fuse to the core. There resulted a continuous uniform polymer coating on the core. The carrier powder coating process is generally known and is described, for example, in U.S. Pat. Nos. 4,935,326; 5,015,550; 4,937,166; 5,002,846 and 5,213,936, the disclosures of which are totally incorporated herein by reference.

The final product was comprised of a carrier core with a total of 0.6 percent by weight of polymer coating of 0.06 percent by weight of TOSPEARL 105™ and 0.54 percent by weight of poly(methyl methacrylate) on the surface. Therefore, the aforementioned polymer coating of poly(methyl methacrylate) and TOSPEARL 105™ polymer premix illustrated herein was comprised of 10 percent of TOSPEARL 105™ and 90 percent of poly(methyl methacrylate). The weight percent of this carrier was determined in this and all following carrier examples by dividing the difference between the weights of the fused carrier and the carrier core by the weight of the fused carrier.

A developer composition was then prepared in this and all following Examples by mixing 100 grams of the above prepared coated carrier with 4.5 grams of an 8.45 micron volume median diameter (volume average diameter) cyan toner, comprised of Polytone-C Cyan 15:3 Pigment, the polytone being a partially crosslinked (about 32 percent) polyester resin obtained by the reactive extrusion of a linear bisphenol A propylene oxide fumarate polymer. The toner composition contained as external surface additives 1.93 percent by weight of a hydrophobic 40 nanometer size titania, 3.36 percent by weight of a 30 nanometer size hydrophobic silica, 0.1 percent by weight of a 12 nanometer size hydrophobic silica and 0.5 weight percent of zinc stearate. The final toner composition had a melt flow index of 9. This developer was conditioned for, for example, 1 hour at 50 percent RH and 70° F. The resulting developer was shaken on a paint shaker at 715 rpm in a 4 ounce jar and a 0.30 gram coated carrier sample was removed after 20 minutes. Thereafter, the triboelectric charge on the carrier particles was determined by the known Faraday Cage process, and there was measured on the carrier a negative charge of 39.8 microcoulombs per gram. Further, the conductivity of the carrier as determined by forming a 0.1 inch magnetic brush of the carrier particles, and measuring the conductivity by imposing a 30 volt potential across the brush was $7.43\times10^{-9}$ (ohm-cm)$^{-1}$. Therefore, these carrier particles were conductive.

CARRIER EXAMPLE II

Preparation of 0.42 Percent by Weight of the Silicone Resin TOSPEARL 105™ and 0.98 Percent by Weight of Polymethylmethacrylate Coated Carrier The processes of Example I were repeated in that a polymer premix of 30 percent by weight of the silicone resin methylsilsesquioxane (TOSPEARL 105™) with a medium particle size diameter of from about 400 to about 800 nanometers, and 70 percent by weight of polymethylmethacrylate (MP-116) was prepared as described in Carrier Example I.

Subsequently, a core/polymer premix was prepared by combining 762 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at certain setpoints (kiln angle, kiln rpm, feedrate of core/polymer mix) of Example I was 32.4 minutes. The volume loading of the kiln at these same setpoints was 10.9 percent of the total volume of the kiln. The peak bed temperature of the materials under these conditions was 448° F., thereby causing the polymer to melt and fuse to the core.

The final product was comprised of a carrier core with a total of 1.4 percent by weight of polymer coating consisting of 0.42 percent by weight of TOSPEARL 105™ and 0.98 percent by weight of poly(methyl methacrylate) on the surface. Therefore, the aforementioned polymer coating of poly (methyl methacrylate) and TOSPEARL 105™ polymer premix illustrated herein was comprised of 30 percent of TOSPEARL 105™ and 70 percent of poly(methyl methacrylate).

A developer composition was then prepared by following the process of Carrier Example I. Thereafter, the triboelectric charge on the carrier particles was determined by the known Faraday Cage process, and there was measured on the carrier a negative charge of 31.4 microcoulombs per gram. Further, the conductivity of the carrier as determined by forming a 0.1 inch magnetic brush of the carrier particles, and measuring the conductivity by imposing a 30 volt potential across the brush was $2.57\times10^{-1}$ (ohm-cm)$^{-1}$.

CARRIER EXAMPLE III

Preparation of 0.18 Percent by Weight of Silicone Resin TOSPEARL 105™ and 0.42 Percent by Weight of Polymethylmethacrylate Coated Carrier A polymer premix of 30 percent by weight of the silicone resin methylsilsesquioxane (TOSPEARL 105™) with a medium particle size diameter of from about 400 to about 800 nanometers, and 70 percent by weight of polymethylmethacrylate (MP-116) was prepared as described in Carrier Example I.

Subsequently, a core/polymer premix was prepared by combining 326.6 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at the setpoints (kiln angle, rpm and feedrate) stated in Example I was 27.6 minutes. The volume loading of the kiln at these same setpoints was 8.8 percent of the total volume of the kiln. The peak bed temperature of the materials under these conditions was 454° F., thereby causing the polymer to melt and fuse to the core.

The final carrier product was comprised of the above carrier core with a total of 0.6 percent by weight of polymer coating consisting of 0.18 percent by weight of TOSPEARL 105™ and 0.42 percent by weight of poly(methyl methacrylate) on the surface. Therefore, the aforementioned polymer coating of poly(methyl methacrylate) and TOSPEARL 105™ polymer premix illustrated herein was comprised of 30 percent of TOSPEARL 105™ and 70 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 33.9 microcoulombs per gram. Further, the conductivity of the carrier as determined by forming a 0.1 inch magnetic brush of the carrier particles, and measuring the conductivity by imposing a 30 volt potential across the brush was $1.09\times10^{-8}$ (ohm-cm)$^{-1}$.

CARRIER EXAMPLE IV

Preparation of 0.14 Percent by Weight of the Silicone Resin TOSPEARL 105™ and 1.26 Percent by Weight of Polymethylmethacrylate Coated Carrier A polymer premix of 10 percent by weight of silicone resin, specifically a methylsilsesquioxane (TOSPEARL 105™) with a medium particle size diameter of from about 400 to about 700 nanometers, and 90 percent by weight of polymethylmethacrylate (MP-116) was prepared as described in Carrier Example I.

Subsequently, a core/polymer premix was prepared by combining 762 grams of the above generated resulting polymer premix with 120 pounds of 82 micron volume median diameter irregular steel core. The resulting core/premix was mixed and fused into carrier as described in Carrier Example I. The resulting residence time of the materials at the setpoints (kiln angle, rpm and feedrate) stated in Example I was 39.6 minutes. The volume loading of the kiln at these same setpoints was 13.2 percent of the total volume of the kiln. The peak bed temperature of the core/polymer mix as it traveled through the furnace under these conditions was 440° F., thereby causing the polymer to melt and fuse to the core.

The final carrier product was comprised of the above steel carrier core with a total of 1.4 percent by weight of polymer coating consisting of 0.14 percent by weight of TOSPEARL 105™ and 1.26 percent by weight of poly(methyl methacrylate) on the surface. Therefore, the aforementioned polymer coating of poly(methyl methacrylate) and TOSPEARL 105™ polymer premix illustrated herein was comprised of 10 percent of TOSPEARL 105™ and 90 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 37.3 microcoulombs per gram. Further, the conductivity of the carrier as determined by forming a 0.1 inch magnetic brush of the carrier particles, and measuring the conductivity by imposing a 30 volt potential across the brush was $3.98\times10^{-10}$ (ohm-cm)$^{-1}$.

CARRIER EXAMPLE V

Preparation of 0.1 Percent by Weight of the Silicone Resin TOSPEARL XC99-A8808™ and 1 Percent by Weight of Polymethylmethacrylate Coated Carrier A polymer premix of 9 percent by weight of methylsilsesquioxane (TOSPEARL XC99-A8808™) with a medium particle size diameter of from about 400 to about 1,000 nanometers (XC99-A8808—available commercially from GE Silicones Inc., Waterford, N.Y.) and 91 percent by weight of polymethylmethacrylate (MP-116) was prepared as described in Carrier Example I.

Subsequently, a core/polymer premix was prepared by combining 598.7 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at the setpoints (kiln angle, rpm and feedrate) stated in Example I was 28.2 minutes. The volume loading of the kiln at these same setpoints was 9.38 percent of the total volume of the kiln. The peak bed temperature of the materials under these conditions was 441° F., thereby causing the polymer to melt and fuse to the core.

The final carrier product was comprised of a carrier core with a total of 1.1 percent by weight of polymer coating consisting of 0.1 percent by weight of TOSPEARL XC99-A8808™ and 1 percent by weight of poly(methyl methacrylate) on the surface. Therefore, the aforementioned polymer coating of poly(methyl methacrylate) and XC99-A8808 polymer premix illustrated herein was comprised of 9 percent of XC99-A8808 and 91 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 40.4 microcoulombs per gram. Further, the conductivity of the carrier as determined by forming a 0.1 inch magnetic brush of the carrier particles, and measuring the conductivity by imposing a 30 volt potential across the brush was $5.23\times10^{-9}$ (ohm-cm)$^{-1}$.

CARRIER EXAMPLE VI

Preparation of 0.2 Percent by Weight of the Silicone Resin TOSPEARL XC99-A8808™ and 1 Percent by Weight of Polymethylmethacrylate Coated Carrier A polymer premix of 17 percent by weight of methylsilsesquioxane (TOSPEARL XC99-A8808™) with a medium particle size diameter of from about 400 to about 1,000 nanometers and 83 percent by weight of polymethylmethacrylate (MP-116) was prepared as described in Carrier Example I.

Subsequently, a core/polymer premix was prepared by combining 653.2 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at the setpoints (kiln angle, rpm and feedrate) stated in Example I was 26.5 minutes. The volume loading of the kiln at these same setpoints was 8.8 percent of the total volume of the kiln. The peak bed temperature of the materials under these conditions was 441° F., thereby causing the polymer to melt and fuse to the core.

The final carrier product was comprised of a carrier core with a total of 1.2 percent by weight of polymer consisting of 0.2 percent by weight of TOSPEARL XC99-A8808™ and 1 percent by weight of poly(methyl methacrylate) coating on the surface. Therefore, the aforementioned polymer coating of poly(methyl methacrylate) and XC99-A8808 polymer premix illustrated herein was comprised of 17 percent of XC99-A8808 and 83 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 39.2 microcoulombs per gram. Further, the conductivity of the carrier as determined by forming a 0.1 inch magnetic brush of the carrier particles, and measuring the conductivity by imposing a 30 volt potential across the brush was $8.42\times10^{-9}$ (ohm-cm)$^{-1}$.

CARRIER EXAMPLE VII

Preparation of 0.3 Percent by Weight of the Silicone Resin TOSPEARL XC99-A8808™ and 1 Percent by Weight of Polymethylmethacrylate Coated Carrier A polymer premix of 23 percent by weight of methylsilsesquioxane (TOSPEARL XC99-A8808™) with a medium particle size diameter of from about 400 to about 1,000 nanometers and 77 percent by weight of polymethylmethacrylate (MP-116) was prepared as described in Carrier Example I.

Subsequently, a core/polymer premix was prepared by combining 707.6 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at the setpoints (kiln angle, rpm and feedrate) stated in Example I was 27.8 minutes. The volume loading of the kiln at these same setpoints was 9.26 percent of the total volume of the kiln. The peak bed temperature of the materials under these conditions was 440° F., thereby causing the polymer to melt and fuse to the core.

The final carrier product was comprised of a carrier core with a total of 1.3 percent by weight of polymer coating consisting of 0.3 percent by weight of TOSPEARL XC99-A8808™ and 1 percent by weight of poly(methyl methacrylate) on the surface. Therefore, the aforementioned polymer coating of poly(methyl methacrylate) and XC99-A8808 polymer premix illustrated herein was comprised of 23 percent of XC99-A8808 and 77 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 34.6 microcoulombs per gram. Further, the conductivity of the carrier as determined by forming a 0.1 inch magnetic brush of the carrier particles, and measuring the conductivity by imposing a 30 volt potential across the brush was $5.20\times10^{-9}$ (ohm-cm)$^{-1}$.

CARRIER EXAMPLE VIII

Preparation of 0.4 Percent by Weight of the Silicone Resin TOSPEARL XC99-A8808™ and 1 Percent by Weight of Polymethylmethacrylate Coated Carrier A polymer premix of 29 percent by weight of the methylsilsesquioxane (TOSPEARL XC99-A8808™) with a medium particle size diameter from about 400 to about 1,000 nanometers and 71 percent by weight of polymethylmethacrylate (MP-116) was prepared as described in Carrier Example I.

Subsequently, a core/polymer premix was prepared by combining 762 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at the setpoints (kiln angle, rpm and feedrate) stated in Example I was 27.8 minutes. The volume loading of the kiln at these same setpoints was 9.26 percent of the total volume of the kiln. The peak bed temperature of the materials under these conditions was 439° F., thereby causing the polymer to melt and fuse to the core.

The final carrier product was comprised of a carrier core with a total of 1.4 percent by weight of polymer coating consisting of 0.4 percent by weight of TOSPEARL XC99-A8808™ and 1 percent by weight of poly(methyl methacrylate) on the surface. Therefore, the aforementioned polymer coating of poly(methyl methacrylate) and XC99-A8808 polymer premix illustrated herein was comprised of 29 percent of XC99-A8808 and 71 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 32.9 microcoulombs per gram. Further, the conductivity of the carrier as determined by forming a 0.1 inch magnetic brush of the carrier particles, and measuring the conductivity by imposing a 30 volt potential across the brush was $1.26\times10^{-9}$ (ohm-cm)$^{-1}$.

CARRIER EXAMPLE IX

Preparation of 0.5 Percent by Weight of the Silicone Resin TOSPEARL XC99-A8808™ and Percent by Weight of Polymethylmethacrylate Coated Carrier A polymer premix of 33 percent by weight of the methylsilsesquioxane (TOSPEARL XC99-A8808™) with a medium particle size diameter of from about 400 to about 1,000 nanometers and 67 percent by weight of polymethylmethacrylate (MP-116) was prepared as described in Carrier Example I.

Subsequently, a core/polymer premix was prepared by combining 816.5 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at the setpoints (kiln angle, rpm and feedrate) stated in Example I was 27.6 minutes. The volume loading of the kiln at these same setpoints was 9.2 percent of the total volume of the kiln. The peak bed temperature of the materials under these conditions was 443° F., thereby causing the polymer to melt and fuse to the core.

The final carrier product was comprised of a carrier core with a total of 1.5 percent by weight of polymer coating consisting of 0.5 percent by weight of TOSPEARL XC99-A8808™ and 1 percent by weight of poly(methyl methacrylate) on the surface. Therefore, the aforementioned polymer coating of poly(methyl methacrylate) and XC99-A8808 polymer premix illustrated herein was comprised of 33 percent of XC99-A8808 and 67 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 31.7 microcoulombs per gram. Further, the conductivity of the carrier as determined by forming a 0.1 inch magnetic brush of the carrier particles, and measuring the conductivity by imposing a 30 volt potential across the brush was $1.48\times10^{-9}$ (ohm-cm)$^{-1}$.

CARRIER EXAMPLE X

Preparation of 0.2 Percent by Weight of the Silicone Resin TOSPEARL XC99-A8808™ and 2 Percent by Weight of Polymethylmethacrylate Coated Carrier A polymer premix of 9 percent by weight of the methylsilsesquioxane (TOSPEARL XC99-A8808™) with a medium particle size diameter of from about 400 to about 1,000 nanometers and 91 percent by weight of polymethylmethacrylate (MP-116) was prepared as described in Carrier Example I.

Subsequently, a core/polymer premix was prepared by combining 1,197.5 grams of the above generated resulting polymer premix with 120 pounds of 82 micron volume median diameter irregular steel core. The resulting core/premix was mixed and fused into carrier as described in Carrier Example I. The resulting residence time of the core/polymer mix as it traveled through the furnace at the setpoints stated in Example I was 28.5 minutes. The volume loading of the kiln at these same setpoints (kiln angle, rpm and feedrate) was 9.5 percent of the total volume of the kiln. The peak bed temperature of the materials under these conditions was 405° F., thereby causing the polymer to melt and fuse to the core.

The final carrier product was comprised of a carrier core with a total of 2.2 percent by weight of polymer coating consisting of 0.2 percent by weight of TOSPEARL XC99-A8808™ and 2 percent by weight of poly(methyl methacrylate) on the surface. Therefore, the aforementioned polymer coating of poly(methyl methacrylate) and XC99-A8808 polymer premix illustrated herein was comprised of 9 percent of XC99-A8808 and 91 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 36.9 microcoulombs per gram. Further, the conductivity of the carrier as determined by forming a 0.1 inch magnetic brush of the carrier particles, and measuring the conductivity by imposing a 30 volt potential across the brush was $1.32\times10^{-10}$ (ohm-cm)$^{-1}$.

CARRIER EXAMPLE XI

Preparation of 0.22 Percent by Weight of the Silicone Resin TOSPEARL 105™ and 0.88 Percent by Weight of Polymethylmethacrylate Coated Carrier A polymer premix of 20 percent by weight of the methylsilsesquioxane (TOSPEARL 105™) with a medium particle size diameter from about 400 to about 800 nanometers and 80 percent by weight of polymethylmethacrylate (MP-116) was prepared as described in Carrier Example I.

Subsequently, a core/polymer premix was prepared by combining 49.9 grams of the above generated resulting polymer premix with 10 pounds of 82 micron volume median diameter irregular steel core and were mixed in a 5 liter M5R blender (available from Littleford Day Inc.). The mixing was accomplished at 220 rpm for a period of 10 minutes. There resulted uniformly distributed and electrostatically attached polymer premix on the steel core as determined by visual observation.

The resulting carrier mixture was then processed in a three-inch i.d. rotary furnace (obtained from Harper International Inc., Lancaster N.Y.) under the following conditions; 6 rpm tube rotation, 43 grams/minute feedrate and 0.4 degree furnace angle at 450° F. temperature setpoint, thereby causing the polymer to melt and fuse to the core.

The final carrier product was comprised of a carrier core with a total of 1.1 percent by weight of polymer coating consisting of 0.22 percent by weight of TOSPEARL 105™ and 0.88 percent by weight of poly(methyl methacrylate) on the surface. Therefore, the aforementioned polymer coating of poly(methyl methacrylate) and TOSPEARL 105™ polymer premix illustrated herein was comprised of 20 percent of TOSPEARL 105™ and 80 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 31.6 microcoulombs per gram. Further, the conductivity of the carrier as determined by forming a 0.1 inch magnetic brush of the carrier particles, and measuring the conductivity by imposing a 30 volt potential across the brush was $3.42\times10^{-9}$ (ohm-cm)$^{-1}$.

CARRIER EXAMPLE XII

Preparation of 0.22 Percent by Weight of the Silicone Resin TOSPEARL 120™ and 0.88 Percent by Weight of Polymethylmethacrylate Coated Carrier A polymer premix of 20 percent by weight of the methylsilsesquioxane (TOSPEARL 120™) with a medium particle size diameter of from about 1,700 to about 3,000 nanometers (TOSPEARL 120™ available commercially from GE Silicones Inc., Waterford, N.Y.), and 80 percent by weight of polymethylmethacrylate (MP-116) was prepared as described in Carrier Example I.

Subsequently, a core/polymer premix was prepared by combining 49.9 grams of the above generated resulting polymer premix with 10 pounds of 82 micron volume median diameter irregular steel core and were mixed in a 5 liter M5R blender (available from Littleford Day Inc.). The mixing was accomplished at 220 rpm for a period of 10 minutes. There resulted uniformly distributed and electrostatically attached polymer premix on the steel core as determined by visual observation.

The resulting mixture was then processed in a three-inch i.d. rotary furnace (obtained from Harper International Inc., Lancaster N.Y.) under the following conditions; 6 rpm tube rotation, 43 grams/minute feedrate and 0.4 degree furnace angle at 450° F. temperature setpoint, thereby causing the polymer to melt and fuse to the core.

The final carrier product was comprised of a carrier core with a total of 1.1 percent by weight of polymer coating consisting of 0.22 percent by weight of TOSPEARL 120™ and 0.88 percent by weight of poly(methyl methacrylate) on the surface. Therefore, the aforementioned polymer coating of poly(methyl methacrylate) and TOSPEARL 120™ polymer premix illustrated herein was comprised of 20 percent of TOSPEARL 120™ and 80 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 37.9 microcoulombs per gram. Further, the conductivity of the carrier as determined by forming a 0.1 inch magnetic brush of the carrier particles, and measuring the conductivity by imposing a 30 volt potential across the brush was $2.21\times10^{-11}$ (ohm-cm)$^{-1}$.

CARRIER EXAMPLE XIII

Preparation of 0.2 Percent by Weight of the Silicone Resin TOSPEARL XC99-A8808™ and 1 Percent by Weight of Polymethylmethacrylate Coated Carrier There was prepared by mixing in a 130 liter 130D blender (available from Littleford Day Inc., Florence Ky.) a polymer premix composing 17 percent by weight of the methylsilsesquioxane (TOSPEARL XC99-A8808™) with a medium particle size diameter of from about 400 to about 1,000 nanometers and 83 percent by weight of polymethylmethacrylate (MP-116). The polymer premix product was blended for 4 minutes at a plow speed of 156 rpm and a chopper speed of 2,600 rpm.

Subsequently, a core/polymer premix was prepared by combining 653 grams of the above generated resulting polymer premix with 120 pounds of 82 micron volume median diameter irregular steel core. The resulting core/premix was mixed and fused into carrier as described in Carrier Example I.

The final carrier product was comprised of a carrier core with a total of 1.2 percent by weight of polymer coating consisting of 0.2 percent by weight of TOSPEARL XC99-A8808™ and 1 percent by weight of poly(methyl methacrylate) on the surface. Therefore, the aforementioned polymer coating of poly(methyl methacrylate) and XC99-A8808 polymer premix illustrated herein was comprised of 17 percent of XC99-A8808 and 83 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 37.1 microcoulombs per gram. Further, the conductivity of the carrier as determined by forming a 0.1 inch magnetic brush of the carrier particles, and measuring the conductivity by imposing a 30 volt potential across the brush was $8.25\times10^{-9}$ (ohm-cm)$^{-1}$.

CARRIER EXAMPLE XIV

Preparation of 0.2 Percent by Weight of the Silicone Resin TOSPEARL XC99-A8808™ and 1 Percent by Weight of Polymethylmethacrylate Coated Carrier There was prepared by mixing in a 130 liter 130D blender (available from Littleford Day Inc., Florence Ky.) a polymer premix composing 17 percent by weight of the methylsilsesquioxane (TOSPEARL XC99-A8808™) with a medium particle size diameter of from about 400 to about 1,000 nanometers and 83 percent by weight of polymethylmethacrylate (MP-116). The polymer premix product was blended for 4 minutes at a plow speed of 156 rpm and a chopper speed of 2,600 rpm.

Subsequently, a core/polymer premix was prepared by combining 8,883.1 grams of the above generated resulting polymer premix with 1,632 pounds of 82 micron volume median diameter irregular steel core and mixing in a Munson style blender (Model #700-THX-15-SS, obtained from Munson Machinery Company Inc., Utica, N.Y.). The mixing was accomplished at 9 rpm for a period of 30 minutes. The resulting core/premix was mixed and fused into carrier as described in Carrier Example I.

The final carrier product was comprised of a carrier core with a total of 1.2 percent by weight of polymer coating consisting of 0.2 percent by weight of TOSPEARL XC99-A8808™ and 1 percent by weight of poly(methyl methacrylate) on the surface. Therefore, the aforementioned polymer coating of poly(methyl methacrylate) and XC99-A8808 polymer premix illustrated herein was comprised of 17 percent of XC99-A8808 and 83 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 37.6 microcoulombs per gram. Further, the conductivity of the carrier as determined by forming a 0.1 inch magnetic brush of the carrier particles, and measuring the conductivity by imposing a 30 volt potential across the brush was $3.91\times10^{-9}$ (ohm-cm)$^{-1}$.

CARRIER EXAMPLE XV

Preparation of 0.2 Percent by Weight of the Silicone Resin TOSPEARL XC99-A8808™ and 1 Percent by Weight of Polymethylmethacrylate Coated Carrier There was prepared by mixing in a 130 liter 130D blender (available from Littleford Day Inc., Florence Ky.) a polymer premix composing 17 percent by weight of the methylsilsesquioxane resin (TOSPEARL XC99-A8808™) with a medium particle size diameter of from about 400 to about 1,000 nanometers and 83 percent by weight of polymethylmethacrylate (MP-116). The polymer premix product was blended for 4 minutes at a plow speed of 156 rpm and a chopper speed of 2,600 rpm.

Subsequently, a core/polymer premix was prepared by combining 8,883.1 grams of the above generated resulting polymer premix with 1,632 pounds of 82 micron volume median diameter irregular steel core and mixing in a Munson style blender (Model #700-THX-15-SS, obtained from Munson Machinery Company Inc., Utica, N.Y.). The mixing was accomplished at 9 rpm for a period of 30 minutes.

The resulting core/premix was fused into carrier in a sixteen-inch i.d. rotary furnace (obtained from Harper International Inc., Lancaster N.Y., Model #NOU-16D165-RTA-WC-10) under the conditions of 6 rpm, feedrate of 1,000 pounds per hour, and furnace angle of 0.6 degree thereby causing the polymer to melt and fuse to the core. This resulted in a continuous uniform polymer coating on the core.

The final carrier product was comprised of a carrier core with a total of 1.2 percent by weight of polymer coating consisting of 0.2 percent by weight of TOSPEARL XC99-A8808™ and 1 percent by weight of poly(methyl methacrylate) on the surface. Therefore, the aforementioned polymer coating of poly(methyl methacrylate) and XC99-A8808 polymer premix illustrated herein was comprised of 17 percent of XC99-A8808 and 83 percent of poly(methyl methacrylate).

A developer composition was then prepared as described in Carrier Example I. Thereafter, the triboelectric charge on the carrier particles was determined by the known Faraday Cage process, and there was measured on the carrier a negative charge of 35.1 microcoulombs per gram. Further, the conductivity of the carrier as determined by forming a 0.1 inch magnetic brush of the carrier particles, and measuring the conductivity by imposing a 30 volt potential across the brush was $5.20\times10^{-9}$ (ohm-cm)$^{-1}$.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A carrier comprised of a core, and thereover a first polymer coating;

wherein the first polymer coating comprises a silicone resin dispersed in a copolymer of polymethyl methacrylate and polyurethane, the silicone resin possessing an average diameter of from about 300 to about 3,000 nanometers and having the formula

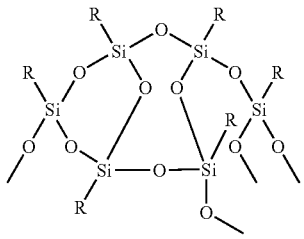

wherein R is alkyl;

and over the first polymer coating a second polymer coating selected from the group consisting of polymethyl methacrylate, sodium lauryl sulfate polymethyl methacrylate, a copolymer of methylmethacrylate/dimethyl aminoethyl methacrylate, a copolymer of methylmethacrylate and tertiarybutylaminoethyl methacrylate, a copolymer of methylmethacrylate and diethylaminoethyl methacrylate, a copolymer of methylmethacrylate and diisopropylaminoethyl methacrylate, and a copolymer of methylmethacrylate and an alkylaminoethyl methacrylate;

wherein the carrier possesses a triboelectric charge of from about 22 to about 38 microcoulombs per gram and a conductivity of from about $10^{-6}$ to about $10^{-11}$ $(\text{ohm-cm})^{-1}$.

2. A carrier in accordance with claim 1 wherein said diameter is from about 300 to about 1,000 nanometers, and wherein said silicone resin is in a powder form.

3. A carrier in accordance with claim 1 wherein said diameter is from 400 to about 800 nanometers.

4. A carrier in accordance with claim 1 wherein the alkylmethacrylate is poly(methylmethacrylate).

5. A carrier in accordance with claim 1 wherein the weight of the two polymer coatings is from about 0.1 to about 20 weight percent, based on the total weight of the carrier.

6. A developer comprised of the carrier of claim 1 and toner.

7. A carrier in accordance with claim 1 wherein said silicone resin is an alkylsilsesquioxane.

8. A carrier in accordance with claim 7 wherein said resin is present in an amount of from about 0.05 to about 0.50 weight percent, and wherein said alkyl contains from 1 to about 12 carbon atoms.

9. A carrier in accordance with claim 1 wherein said resin is present in an amount of from about 0.20 to about 0.30 weight percent.

10. The carrier of claim 1, wherein the polymer coating contains no conductive component.

11. A developer comprising (1) a toner and (2) a carrier;

wherein the carrier comprises a core, a first polymer coating layer over the core, and a second polymer coating over the first polymer coating, wherein the first polymer coating comprises a copolymer of polymethyl methacrylate and polyurethane, and a silicone resin of the formula:

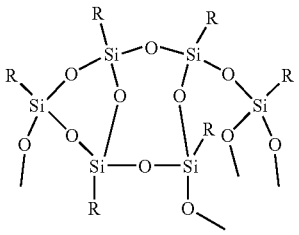

wherein R is alkyl;

the second polymer coating is selected from the group consisting of polymethyl methacrylate, sodium lauryl sulfate polymethyl methacrylate, a copolymer of methylmethacrylate/dimethyl aminoethyl methacrylate, a copolymer of methylmethacrylate and tertiarybutylaminoethyl methacrylate, a copolymer of methylmethacrylate and diethylaminoethyl methacrylate, a copolymer of methylmethacrylate and diisopropylaminoethyl methacrylate, and a copolymer of methylmethacrylate and an alkylaminoethyl methacrylate; and wherein the carrier possesses a triboelectric charge of from about 22 to about 38 microcoulombs per gram and a conductivity of from about $10^{-6}$ to about $10^{-11}$ $(\text{ohm-cm})^{-1}$.

* * * * *